US007710339B2

(12) United States Patent
Forslund

(10) Patent No.: US 7,710,339 B2
(45) Date of Patent: May 4, 2010

(54) ANTENNA DEVICE

(75) Inventor: Ola Forslund, Linköping (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 12/153,142

(22) Filed: May 14, 2008

(65) Prior Publication Data

US 2009/0021440 A1 Jan. 22, 2009

(30) Foreign Application Priority Data

May 14, 2007 (EP) ..... 07445023

(51) Int. Cl.
*H01Q 13/02* (2006.01)

(52) U.S. Cl. ..... 343/772; 343/778; 343/786

(58) Field of Classification Search ..... 343/772, 343/778, 786

See application file for complete search history.

(56) References Cited

U.S. PATENT DOCUMENTS

| | | | | |
|---|---|---|---|---|
| 2,692,336 | A | 10/1954 | Kock | |
| 4,096,483 | A | 6/1978 | Bui Hai et al. | |
| 4,241,353 | A | 12/1980 | Salvat et al. | |
| 4,387,378 | A * | 6/1983 | Henderson | 342/374 |
| 4,574,289 | A * | 3/1986 | Henderson | 343/786 |
| 4,684,952 | A | 8/1987 | Munson et al. | |
| 4,928,109 | A | 5/1990 | Bonebright et al. | |
| 6,384,787 | B1 | 5/2002 | Kim et al. | |

FOREIGN PATENT DOCUMENTS

| | | |
|---|---|---|
| EP | 0004215 A1 | 9/1979 |
| NL | 7602556 A | 9/1976 |

OTHER PUBLICATIONS

Feng-Chi E. Tsai et al; Designing a 161-element Ku-Band Microstrip Reflectarray of Variable Size Patches Using an Equivalent Unit Cell Waveguide Approach; IEEE Transactions on Antennas and Propagation, vol. 51, No. 10; Oct. 2003; pp. 2953-2962.

Robert B. Dybdal; Defocusing Loss for a Log Periodic-Fed Reflector; IEEE Transactions on Antennas and Propagation, vol. AP-33, No. 7; Jul. 1985; pp. 809-812.

(Continued)

*Primary Examiner*—Michael C Wimer
(74) *Attorney, Agent, or Firm*—VENABLE LLP; Eric J. Franklin

(57) ABSTRACT

An antenna device including a reflectarray with array antenna elements, and an outer feed provided with a waveguide and a widening funnel which in a widened end carries a waveguide aperture for illumination of the reflectarray. The antenna device eliminates or at least reduces a position dependence of an antenna lobe with respect to frequency. Furthermore, the antenna device presents a low monostatic radar cross section and compactness. To this end the antenna device is fed offset and is provided with a device for movement of a phase center of the antenna with a frequency relative to the waveguide aperture of the feed in the vicinity of the waveguide aperture.

10 Claims, 2 Drawing Sheets

OTHER PUBLICATIONS

Ola Forslund et al; A Flat Reflector Antenna With Low Radar Cross Section; IRS '98 International Radar Symposium, Munich, Germany, Sep. 1998; pp. 303-311.

Jose A. Encinar; Design of Two-Layer Printed Reflectarrays Using Patches of Variable Size; IEEE Transactions on Antennas and Propagation, vol. 49, No. 10, Oct. 2001; pp. 1403-1410.

Davis M. Pozar et al; Design of Millimeter Wave Microstrip Reflectarrays; IEEE Transactions on Antennas and Propagation, vol. 45, No. 2, Feb. 1997; pp. 287-296.

D.G. Berry et al; The Reflectarray Antenna; IEEE Transactions on Antennas and Propagation; vol. 11, No. 6, Nov. 1963; pp. 645-651.

European Search Report—Aug. 20, 2008.

* cited by examiner

ANTENNA DEVICE

CROSS-REFERENCE TO RELATED APPLICATIONS

This application claims priority to European patent application 07445023.0 filed 14 May 2007.

The present invention relates to an antenna device comprising a reflectarray with array antenna elements, and an outer feed provided with a waveguide and a widening funnel which in the widened end carries a waveguide aperture for illumination of the reflectarray.

Figure 1:
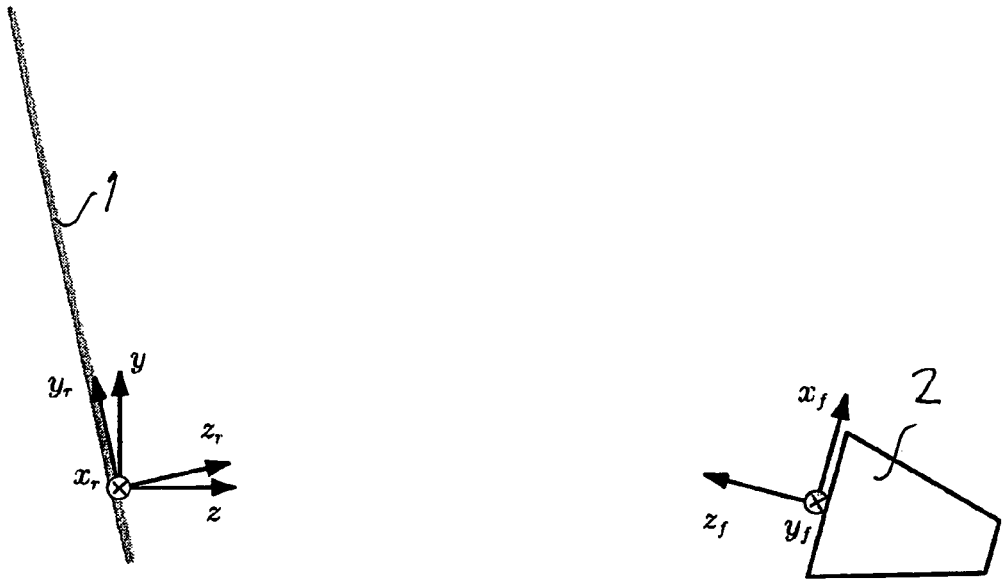

Such an antenna device is i. a. known from U.S. Pat. No. 6,384,787 B1. It is in particular referred to FIG. 1 showing a centralized outer horn feed feeding a reflectarray in the shape of patch antenna units. A disadvantage of the centralized positioning of the outer feed of such an antenna device is that the feed and various mechanical devices to position the feed block the aperture field. In order to partly avoid this disadvantage it is per se known in connection to reflector antennas to feed the reflector by an offset arrangement. In this connection it could also be referred to U.S. Pat. No. 4,684,952 disclosing a similar antenna device as known from the US patent referred to above.

A reflectarray can be regarded as an array antenna in which the elements of the array antenna are fed from an outer antenna arrangement, a so called feed. This is similar to the feeding of a reflector antenna. The task of the elements is to give the phase of the reflected field a variation such that focusing of the reflected field is obtained. For example this occurs if the phase of the reflected field varies linearly across the aperture in such a way that for one direction vector $\hat{n}'$ out from the reflecting surface, when the dot product $\hat{n}'\cdot\hat{n}>0$ and $\hat{n}$ is the surface normal of the antenna aperture, a constant phase is obtained for a surface orthogonal to $\hat{n}'$. This implies that the main lobe of the antenna points in a direction $\hat{n}'$.

A consequence of the offset feeding arrangement comprising a reflectarray is that the position of the antenna lobe varies with frequency.

One object with the invention is to eliminate or at least to reduce the influence of the frequency on the position of the antenna lobe.

Another object of the invention is to obtain a low side lobe level.

Still another object is to obtain a low radar cross section, RCS, in particular for out of band frequencies in the intended main lobe direction.

A further object is to make the antenna device and in particular the feed compact.

According to the invention this is obtained by an antenna device with the feed arranged to illuminate the reflectarray in an offset arrangement by arranging a device for movement of the phase centre of the antenna feed with frequency relative to the waveguide aperture of the feed in the vicinity of the waveguide aperture. The offset arrangement in combination with the arrangement for movement of the phase centre cooperate to obtain low side lobe levels and a stable position of the antenna lobe in a compact construction and still obtaining a low radar cross section in the intended main lobe direction for out of band frequencies.

According to a favourable embodiment of the antenna device, the device for movement of the phase centre of the antenna with frequency is an inductive iris or diaphragm comprised in the feeding waveguide close to the widening funnel and asymmetrically positioned. Preferably the device for movement of the phase centre is an elongated beam fixed to an inner wall of the waveguide.

According to a further favourable embodiment of the antenna device the feed comprises a compact array antenna with a plurality of antenna elements, each antenna element comprising a rectangular waveguide aperture. Introduction of a device for movement of the phase centre of the antenna, such as an inductive iris or diaphragm in such an antenna device has turned out to effectively reduce the antenna lobe position dependence of the frequency. At the same time it is rather easily arranged for the mounting of the device for the movement of the phase centre.

According to a still further favourable embodiment of the antenna device, the feed comprises at least two rectangular waveguides feeding the antenna elements of the compact array antenna. Preferably each rectangular waveguide feeds a plurality of antenna elements of the feed. According to a particular proposed antenna device two rectangular waveguides are provided and each waveguide feeds three antenna elements of the feed. These proposed embodiments have turned out to be suitable for introduction of a device for movement of the phase centre.

Furthermore according to yet another favourable embodiment of the antenna device, the reflectarray in extension is dimensioned such that the side lobes of the feed are prevented from reaching its active area comprising antenna elements. In that connection the active area could be surrounded by a thin narrowband microwave absorbing material. The purpose of the thin narrowband microwave absorber is to absorb microwaves within the same frequency band as the antenna operates. Optimizing of the active area in size but still preventing the side lobes from reaching the active reflect array area under consideration of possible antenna position variation in dependence of the frequency results in low side lobe levels.

It is also proposed that the widening funnel is provided with a beam symmetrically arranged in the funnel extending from one side wall to an opposite side wall. This beam arrangement contributes to a symmetrical distribution of the aperture field of the feed field subjected to phase centre movement and facilitates a compact embodiment.

The invention will now be described in more detail with reference to the accompanying drawings in which:

FIG. 1 schematically shows an antenna device with reflectarray and feed according to the invention.

Figure 2A:
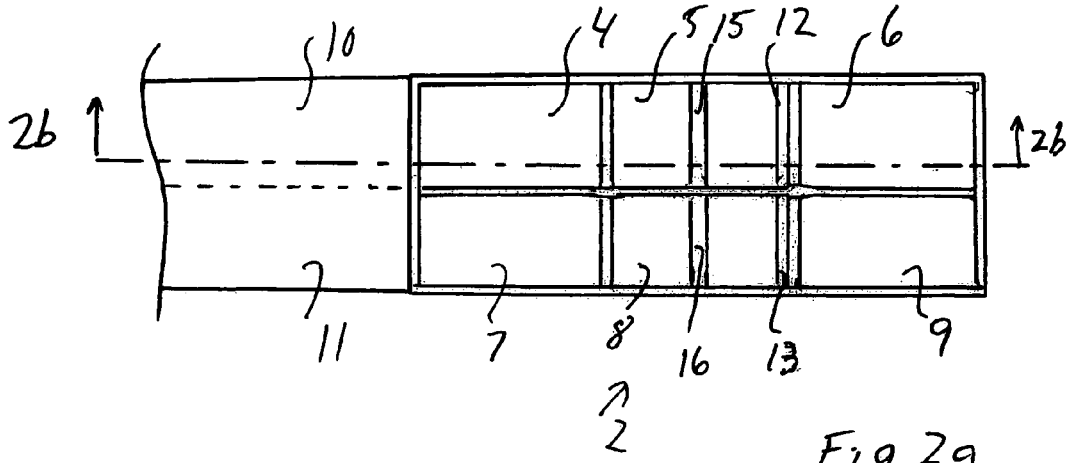

FIG. 2*a* shows a feed suitable for the antenna device according to the invention viewed in a direction perpendicular to the plane of the waveguide aperture.

Figure 2B:
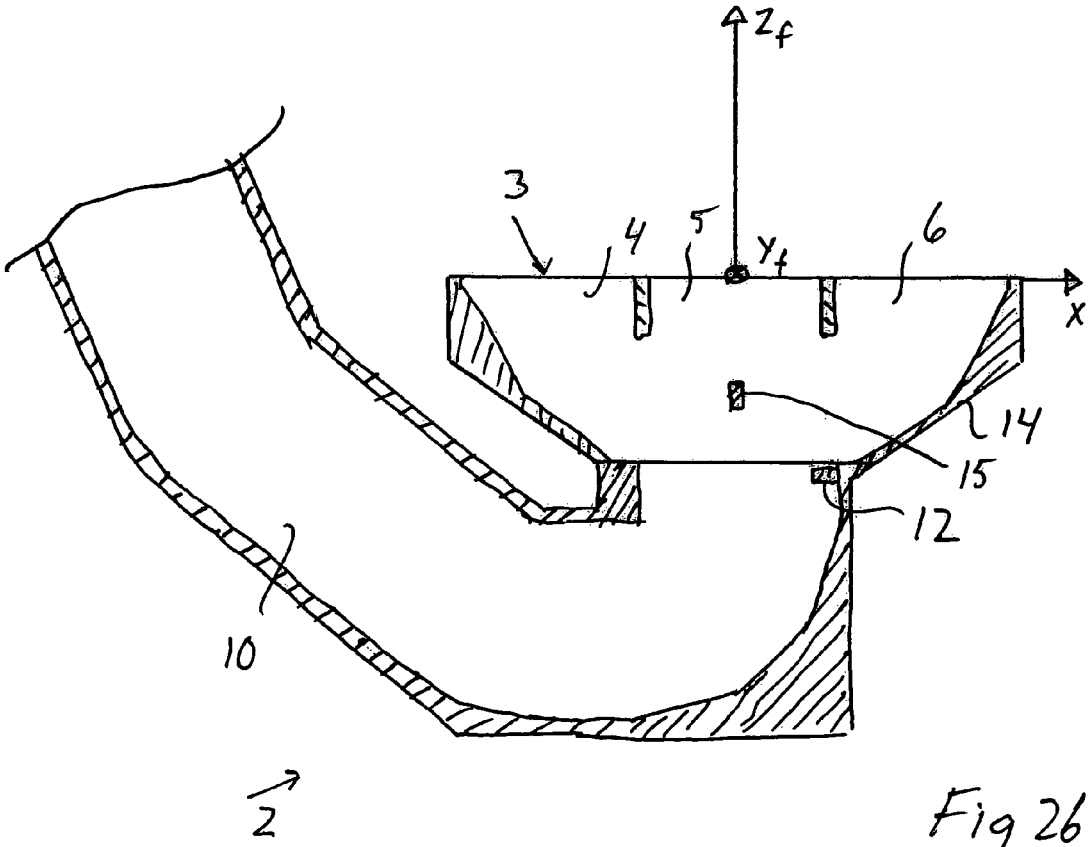

FIG. 2*b* shows the feed according to FIG. 2*a* in a cross section according to the dash-dotted line 2*b*-2*b* in FIG. 2*a*.

Figure 3:
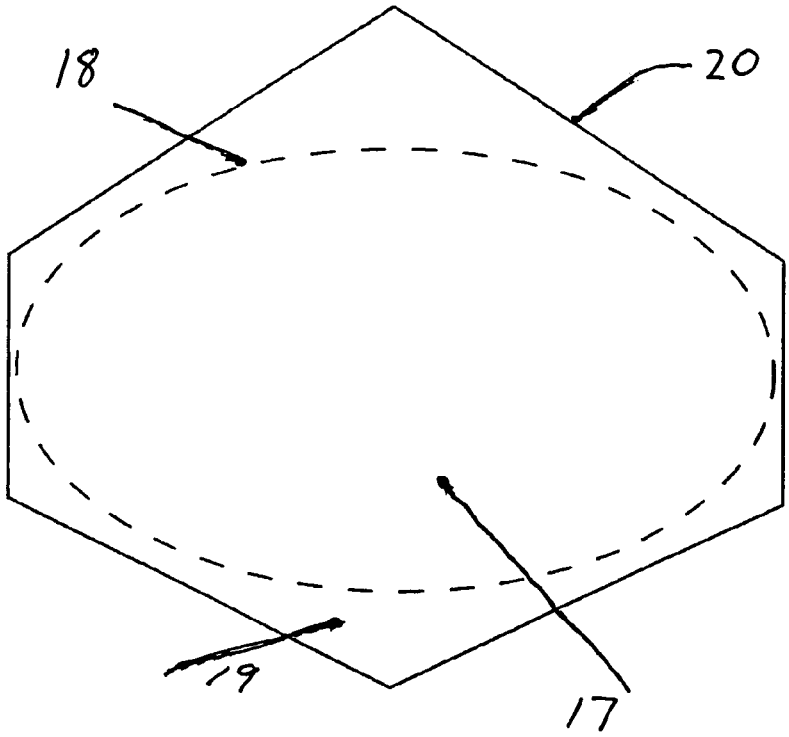

FIG. 3 schematically illustrates possible limitations of the surface of the reflectarray for an antenna device according to the invention.

The schematically shown antenna device of FIG. 1 comprises a plane reflector surface 1 and a feed 2. For the sake of simplicity the mechanical arrangement of the feed relative to the reflectarray has been omitted. The reflectarray 1 is provided with reflecting elements, not shown, in a plane conducting structure.

The elements of the reflectarray can for example consist of waveguide apertures having short circuits at different distances within the waveguides. In this connection it is referred to D. G. Berry, R. G. Malech and W. A. Kennedy; The Reflectarray Antenna; IEEE Transactions on Antennas and Propagation, 11(6), November 1963, pp 645-651. Another alternative for the elements of the reflectarray is to arrange one or several layers of so called patch elements above an earth plane. In this connection it is referred to the article of D. M. Pozar, S. D. Targonski, H. D. Syrigos; Design of Millimeter Wave Microstrip Reflectarrays; IEEE Transactions on Antennas and Propagation, 45(2), February 1997, and the article of J. A. Encinar; Design of Two-Layer Printed Reflectarrays Using Patches of Variable Size; IEEE Transactions on Antennas and Propagation, 49(10), October 2001, pp 1403-1410. Still another alternative for the elements of the reflectarray is to arrange thin short metal strips operating as shortcut dipole antennas above an earth plane. Such arrangements are described in an article of O. Forslund and P. Sjöstrand; A flat reflector antenna with low radar cross section; IRS 98 International Radar Symposium, Munich, Germany, September 1998, pp. 303-311. A more general element in any kind of plane conducting structure can also be considered.

The antenna device shown in FIG. 1 is represented symmetrically with respect to the yz plane apart from the reflecting elements. If the reflectarray 1 shown is designed such that it for a certain frequency $f_0$ obtains a lobe direction along the z axis, a reflectarray designed according to this principle will obtain a low monostatical radar cross section, RCS, for frequencies outside the band of operation of the antenna for a plane wave incident anti parallel to the z axis, that is a low radar cross section is obtained in the intended main lobe direction. The reason for this is that the reflecting surface for out of band frequencies and in particular lower frequencies behaves essentially in the same way as a plane metallic plate or plane mirror. An incident plane wave does not focus towards the feed 2 but is spread bistatically. This is known and i. a. described in the article of Forslund et al mentioned above.

The elements in the reflect array antenna 1, 17 are located in a not shown periodic pattern. However, the elements per se vary in some way from cell to cell in the periodic pattern to obtain focusing within the frequency band. This periodic pattern is the reason why an offset fed antenna obtains a variation of the antenna lobe position in dependence of the frequency so that the antenna lobe assume different positions in the yz plane dependent on the frequency given that the phase centre of the feed 2 is fixed with respect to the frequency. The present invention aims at a compensation for the frequency dependency of the antenna lobe position by introducing a feed having a phase centre that varies with the frequency in such a way that the frequency dependency of the antenna lobe position caused by an offset fed reflectarray with fixed phase centre is compensated for. In the case of a reflectarray having a geometry according to FIGS. 1, 2*a* and 2*b* designed so that the intended main lobe direction is in the z-direction of the global coordinate system (x,y,z), the focal point for $f_0$ coincides with origin of the coordinate system $(x_f,y_f,z_f)$ of the feed, the coordinates being designated $(x_0,y_0,z_0)$ in the global coordinate system (x,y,z). The effective focal point moves with the frequency. Given that the phase centre of the feed is fixed with frequency, in order to maintain a lobe direction along the z-axis for frequencies $f<f_0$, the feed would have to be moved downwards, in the negative y-direction with respect to the global coordinate system (x,y,z). In order to maintain a lobe direction along the z-axis for frequencies $f>f_0$, the feed would have to be moved upwards, in the positive y-direction, with respect to the global coordinate system.

It is now referred to FIGS. 2*a* and 2*b* showing the feed 2 in more detail. The feed 2 in this case consists of a small compact array antenna 3. The antenna elements of the array antenna 3 consist of six rectangular waveguide apertures 4-9. These apertures 4-9 are arranged in a regular 2×3 matrix. The feed is symmetric with respect to the $x_f z_f$ plane referring to FIG. 2*b*. The antenna elements are fed by two rectangular waveguides 10, 11, each waveguide feeding three antenna elements in the shape of waveguide apertures 4-6 and 5-9, respectively.

The feed is provided with an arrangement for movement of the phase centre of the feed with respect to frequency. In order to obtain the desired movement of the phase centre an inductive iris or diaphragm 12 is provided in waveguide 10 and a corresponding inductive iris or diaphragm 13 in waveguide 11. These irises or diaphragms 12, 13 are located in the waveguides 10, 11 along one straight wall of the rectangular waveguides close to the transition of the waveguides into a widening funnel 14. The irises or diaphragms can consist of elongated beams, preferably in metal, reducing the rectangular inner cross section of the waveguides where they are located. The irises or diaphragms are sized and located such that the phase centre of the feed moves with frequency in such a way as to compensate for variations of the lobe position with frequency range as large as possible. In particular, this means that while the phase centre $(x_{f0}, y_{f0}, z_{f0})$ for frequency $f_0$ is located close to origo with respect to the local coordinate system $(x_f, y_f, z_f)$ of the feed, it is located in a position $x_f<0$ for $f<f_0$ and in a position $x_f>0$ for $f>f_0$. The funnel 14 is also provided with two beam sections 15, 16 symmetrically arranged in the funnel behind the waveguide apertures 4-9. The beam sections contribute to the distribution of the field among the apertures and enable a compact design of the feed.

An advantageous way to obtain a low monostatical radar cross section is to give the reflectarray a larger extension, preferably vertically, than what is required to obtain a given desired lobe width and a certain side lobe ratio. If the reflectarray is made large relative to required lobe width a low side lobe level can be obtained. However, there are practical limitations for the illumination operation that can be obtained. If the reflectarray is made so large that the side lobe region of the feed illuminates the reflectarray the performance is degraded due to a phase shift of 180 degrees occurring in the illumination operation when the first null depth of the feed is passed. A schematic illustration of a large reflectarray 1 is found in FIG. 3. In this case the area of the reflectarray 1 extends beyond the main lobe region 17 of the feed 2 which covers the active area 17 of the reflectarray and is terminated by a reflector edge 20. The null depth has been indicated by a dashed oval 18. Outside the oval the side lobe area 19 is found. To obtain a low side lobe level in this case it is proposed to cover the edge region of the reflectarray, i.e. the area illuminated by the side lobes of the feed, with a narrowband microwave absorbing material. The material absorbs microwaves within the same frequency band as the antenna operates. The advantages obtained are a low edge illumination and due to that, low side lobes. Furthermore, since the material is narrowband, the whole flat area, comprising region 17 and 18 act as a flat mirror for out of band frequencies giving a narrow lobe for the bistatical reflex obtained for out of band frequencies which is advantageous from monostatic cross section point of view. By this arrangement a low monostatic radar cross section is obtained for out of band frequencies in particular in the intended main lobe direction and in the whole xz plane referring to the global coordinate system (x, y, z).

A principal object of an antenna device provided with a large and inclined reflect array as described above is to obtain a low radar cross section in the intended main lobe direction and in a horizontal plane section, i.e. in the xz plane referred to the global coordinate system.

The antenna device according to the invention is not limited to the embodiments described above, but can be modified within the framework of the following claims and concept of the invention.

The invention claimed is:

1. An antenna device, comprising:

a reflectarray comprising away antenna elements, an outer feed comprising a waveguide, wherein the feed is arranged to illuminate the reflectarray in an offset arrangement, a widening funnel comprising a widened end including a waveguide aperture for illumination of the reflectarray, and a passive device configured to move a phase center of the antenna feed dependent upon a frequency, wherein the phase center is moved relative to the wave guide aperture of the feed, and wherein the passive device is arranged in the vicinity of the waveguide aperture.

2. The device according to claim 1, wherein the passive device for movement of the phase center of the antenna comprises an inductive iris or diaphragm comprised in the feeding waveguide close to the widening funnel and asymmetrically positioned.

3. The device according to claim 1, wherein the passive device for movement of the phase center comprises an elongated beam fixed to an inner wall of the waveguide.

4. The device according to claim 1, wherein the feed comprises a compact array antenna with a plurality of antenna elements, each antenna element comprising a rectangular waveguide aperture.

5. The device according to claim 4, wherein the feed comprises at least two rectangular waveguides feeding the antenna elements of the compact array antenna.

6. The device according to claim 4, wherein each rectangular waveguide feeds a plurality of antenna elements of the feed.

7. The device according to claim 6, wherein the device comprises two rectangular waveguides, and wherein each waveguide feeds three antenna elements of the feed.

8. The device according to claim 1, wherein the reflectarray comprises an extension that is dimensioned such that side lobes of the feed are prevented from reaching an active area comprising antenna elements.

9. The device according to claim 8, wherein the active area is surrounded by a narrowband microwave absorbing material absorbing microwaves within a same frequency as the antenna device operates.

10. The device according to claim 1, wherein the widening funnel comprises a beam symmetrically arranged in the funnel extending from one side wall to an opposite side wall.

* * * * *